US006264047B1

(12) United States Patent
Crumley

(10) Patent No.: US 6,264,047 B1
(45) Date of Patent: Jul. 24, 2001

(54) CLOTHES HANGING ASSEMBLY

(76) Inventor: Charles E. Crumley, 297-B Avenita Sevilla, Laguna Hills, CA (US) 92653

( * ) Notice: Subject to any disclaimer, the term of this patent is extended or adjusted under 35 U.S.C. 154(b) by 0 days.

(21) Appl. No.: 09/574,530

(22) Filed: May 19, 2000

(51) Int. Cl.[7] ..... A47F 5/00

(52) U.S. Cl. ..... 211/189; 211/195; 211/198; 190/102

(58) Field of Search ..... 211/206, 204, 211/195, 198, 189; 206/284, 278, 298, 289, 292, 300; 190/102

(56) References Cited

U.S. PATENT DOCUMENTS

| | | | | |
|---|---|---|---|---|
| D. 280,467 | | 9/1985 | Mihojevich . | |
| 1,556,624 | * | 10/1925 | Pavenick . | |
| 2,016,688 | * | 10/1935 | Stellies . | |
| 2,122,190 | | 6/1938 | Wendt . | |
| 2,126,986 | * | 8/1938 | Burger . | |
| 2,297,903 | * | 10/1942 | Levine . | |
| 2,927,719 | * | 3/1960 | Wareham . | |
| 3,144,946 | * | 8/1964 | Ellis . | |
| 3,805,966 | * | 4/1974 | Wakeman et al. | 211/175 X |
| 3,881,579 | | 5/1975 | Keerdoja . | |
| 4,134,479 | | 1/1979 | Crider, Jr. . | |
| 4,730,737 | | 3/1988 | Robinson . | |
| 4,863,018 | | 9/1989 | King et al. . | |
| 5,117,951 | * | 6/1992 | Sisson . | |
| 5,617,962 | * | 4/1997 | Chen | 211/206 |
| 6,131,749 | * | 10/2000 | Crockett et al. | 211/195 |

* cited by examiner

*Primary Examiner*—Robert W. Gibson, Jr.

(57) ABSTRACT

A clothes hanging assembly for hanging clothes above a suitcase. The clothes hanging assembly includes an assembly which is mountable to opposing walls in a suitcase. The assembly has a first support structure and second support structure. A clothing support means supports clothes. The clothing support means extends between the fist and second support structures. A mounting assembly includes a first and second pair of securing means. The first pair of securing means removably secures the first support structure to a first wall of the pair of opposing walls. The second pair of securing means removably secures the second support structure to a second wall of the first pair of opposing walls.

11 Claims, 5 Drawing Sheets

CLOTHES HANGING ASSEMBLY

BACKGROUND OF THE INVENTION

1. Field of the Invention

The present invention relates to clothes hanging devices and more particularly pertains to a new clothes hanging assembly for hanging clothes above a suitcase.

2. Description of the Prior Art

The use of clothes hanging devices is known in the prior art. More specifically, clothes hanging devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,134,479; U.S. Pat. No. 4,863,018; U.S. Pat. No. 3,881,579; U.S. Pat. No. 2,122,190; U.S. Des. Pat. No. 280,467; and U.S. Pat. No. 4,730,737.

While these devices fulfill their respective, particular objectives and requirements, the aforementioned patents do not disclose a new clothes hanging assembly. The inventive device includes an assembly which is mountable to opposing walls in a suitcase. The assembly has a first support structure and second support structure. A clothing support means supports clothes. The clothing support means extends between the fist and second support structures. A mounting assembly includes a first and second pair of securing means. The first pair of securing means removably secures the first support structure to a first wall of the pair of opposing walls. The second pair of securing means removably secures the second support structure to a second wall of the first pair of opposing walls.

In these respects, the clothes hanging assembly according to the present invention substantially departs from the conventional concepts and designs of the prior art, and in so doing provides an apparatus primarily developed for the purpose of hanging clothes above a suitcase.

SUMMARY OF THE INVENTION

In view of the foregoing disadvantages inherent in the known types of clothes hanging devices now present in the prior art, the present invention provides a new clothes hanging assembly construction wherein the same can be utilized for hanging clothes above a suitcase.

The general purpose of the present invention, which will be described subsequently in greater detail, is to provide a new clothes hanging assembly apparatus and method which has many of the advantages of the clothes hanging devices mentioned heretofore and many novel features that result in a new clothes hanging assembly which is not anticipated, rendered obvious, suggested, or even implied by any of the prior art clothes hanging devices, either alone or in any combination thereof.

To attain this, the present invention generally comprises an assembly which is mountable to opposing walls in a suitcase. The assembly has a first support structure and second support structure. A clothing support means supports clothes. The clothing support means extends between the fist and second support structures. A mounting assembly includes a first and second pair of securing means. The first pair of securing means removably secures the first support structure to a first wall of the pair of opposing walls. The second pair of securing means removably secures the second support structure to a second wall of the first pair of opposing walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods And systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new clothes hanging assembly apparatus and method which has many of the advantages of the clothes hanging devices mentioned heretofore and many novel features that result in a new clothes hanging assembly which is not anticipated, rendered obvious, suggested, or even implied by any of the prior art clothes hanging devices, either alone or in any combination thereof.

It is another object of the present invention to provide a new clothes hanging assembly which may be easily and efficiently manufactured and marketed.

It is a further object of the present invention to provide a new clothes hanging assembly which is of a durable and reliable construction.

An even further object of the present invention is to provide a new clothes hanging assembly which is susceptible of a low cost of manufacture with regard to both materials and labor, and which accordingly is then susceptible of low prices of sale to the consuming public, thereby making such clothes hanging assembly economically available to the buying public.

Still yet another object of the present invention is to provide a new clothes hanging assembly which provides in the apparatuses and methods of the prior art some of the advantages thereof, while simultaneously overcoming some of the disadvantages normally associated therewith.

Still another object of the present invention is to provide a new clothes hanging assembly for hanging clothes above a suitcase.

Yet another object of the present invention is to provide a new clothes hanging assembly which includes an assembly which is mountable to opposing walls in a suitcase. The assembly has a first support structure and second support structure. A clothing support means supports clothes. The clothing support means extends between the fist and second support structures. A mounting assembly includes a first and second pair of securing means. The first pair of securing means removably secures the first support structure to a first wall of the pair of opposing walls. The second pair of securing means removably secures the second support structure to a second wall of the first pair of opposing walls.

Still yet another object of the present invention is to provide a new clothes hanging assembly that may be disassembled for carrying within the suitcase.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
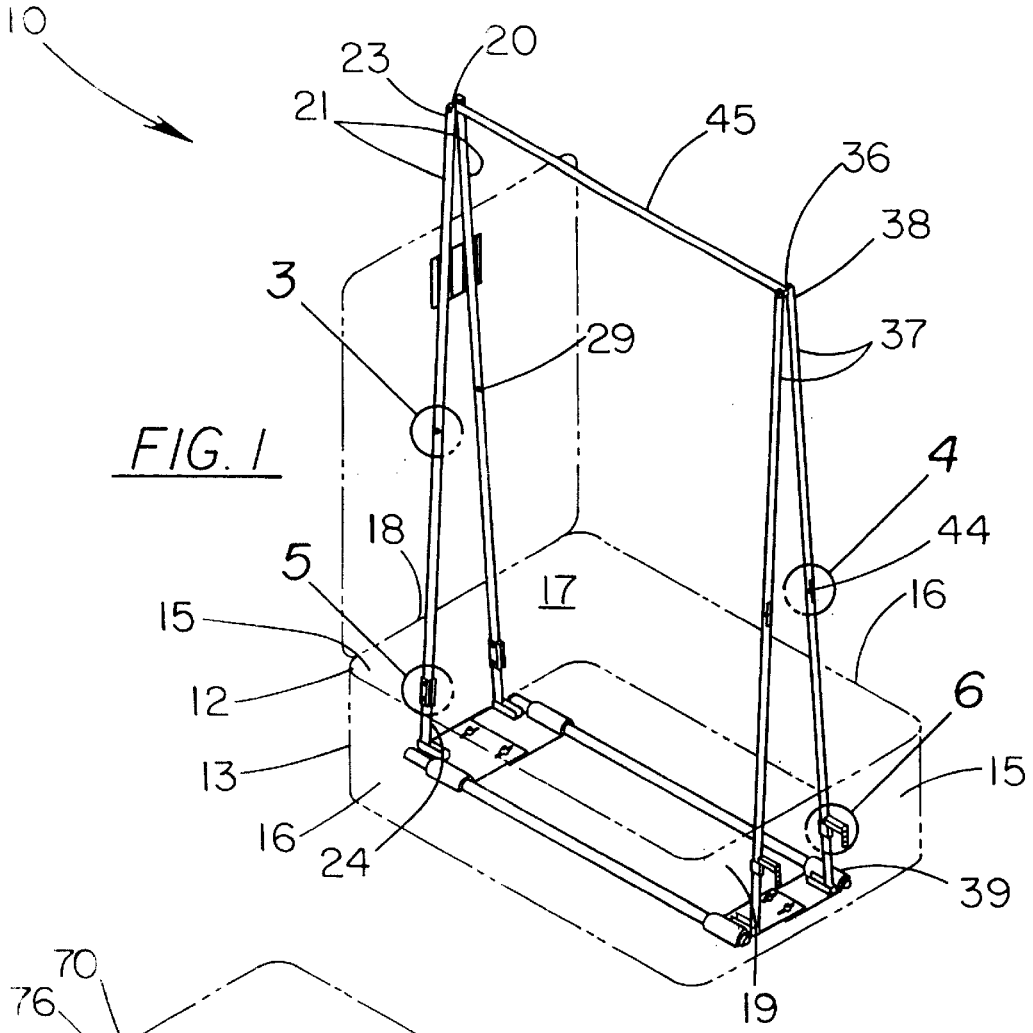
FIG. 1 is a schematic perspective view of a new clothes hanging assembly according to the present invention.
Figure 2:
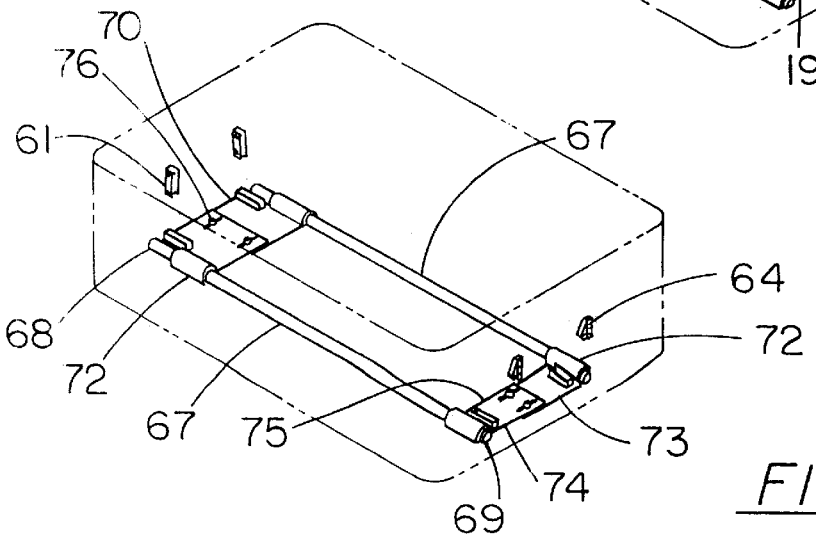
FIG. 2 is a schematic perspective view of a suitcase of the present invention.
Figure 3:
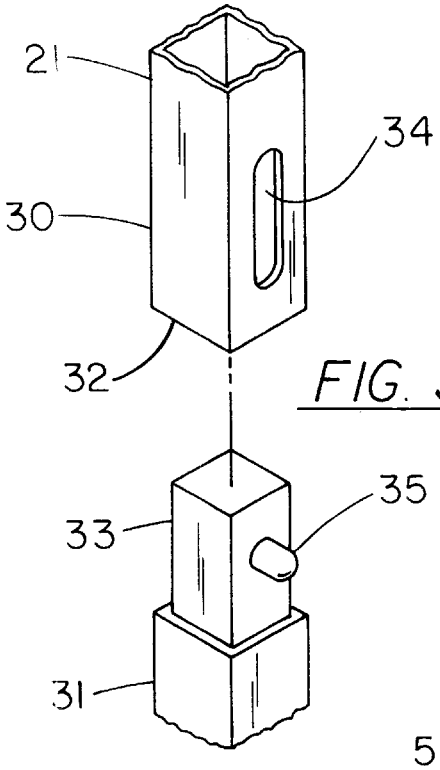
FIG. 3 is a schematic perspective view of a juncture of the first and second portions of the first support structure of the present invention.
Figure 4:
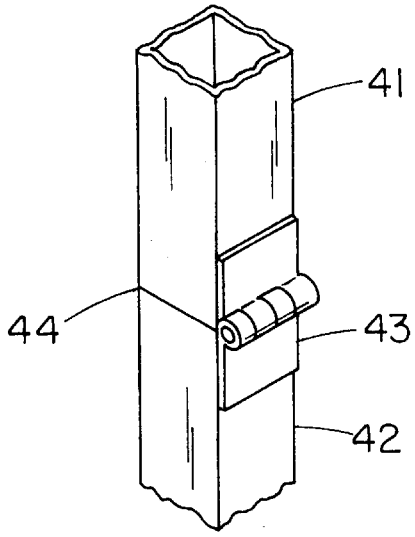
FIG. 4 is a schematic perspective view of a juncture of the first and second portions of the second support structure of the present invention.
Figure 5:
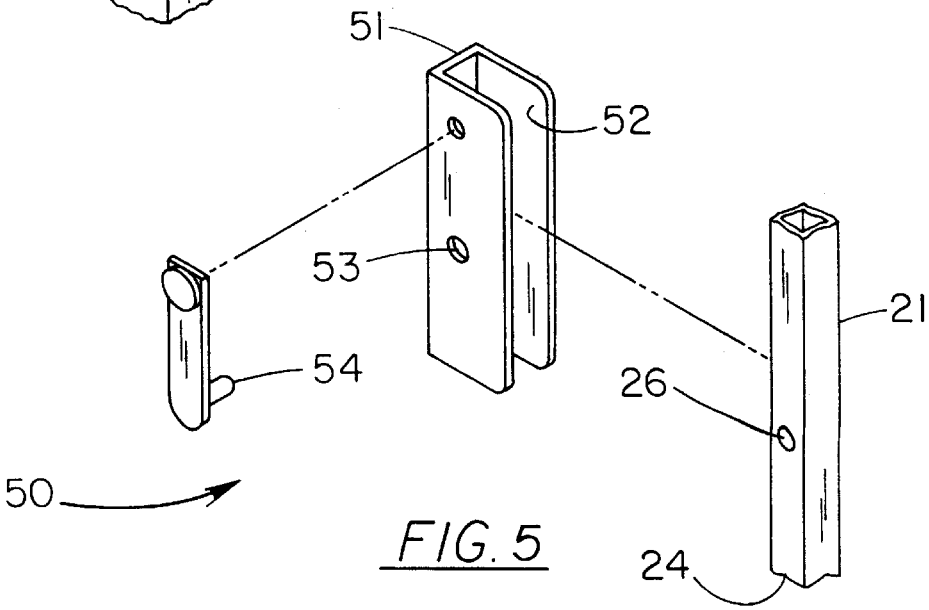
FIG. 5 is a schematic perspective view of the first securing means of the present invention.
Figure 6:
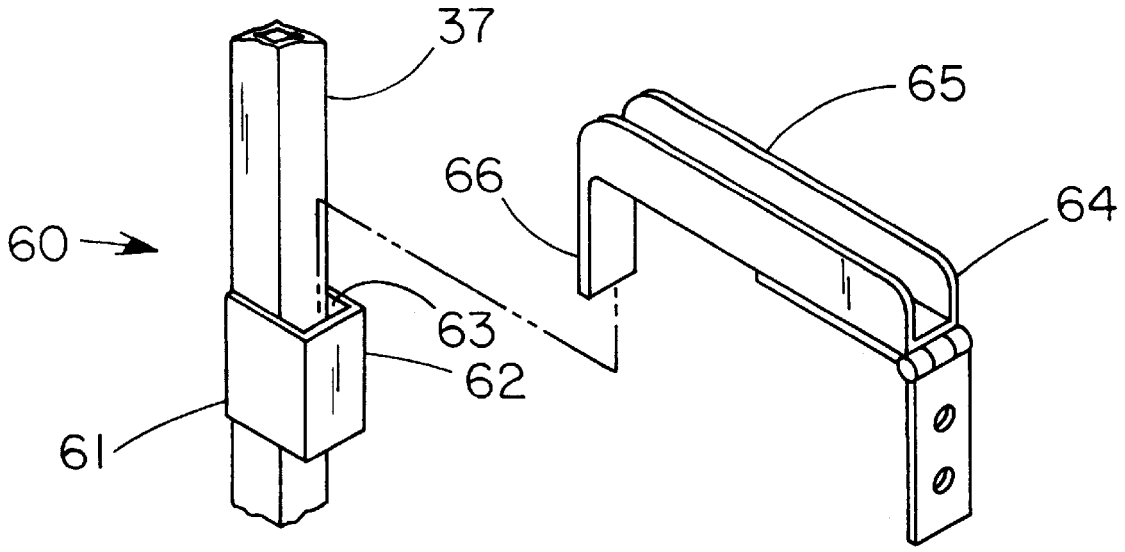
FIG. 6 is a schematic perspective view of the second securing means of the present invention.
Figure 8:
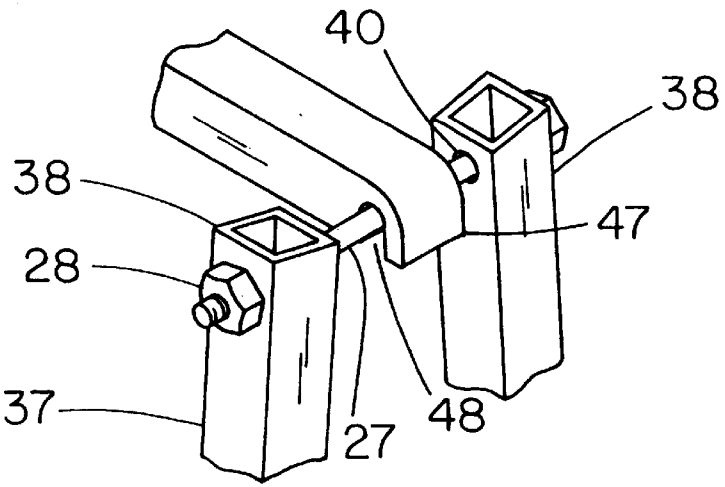
FIG. 8 is a schematic perspective view of the second end of the clothes hanging means of the present invention.
Figure 7:
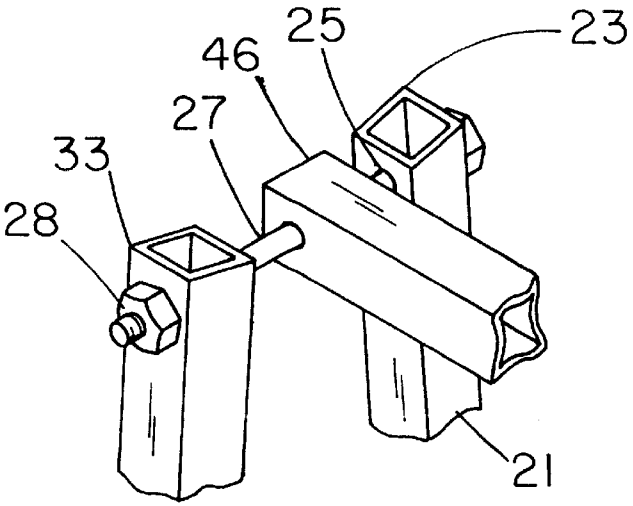
FIG. 7 is a schematic perspective view of the first end of the clothes hanging means of the present invention.
Figure 9:
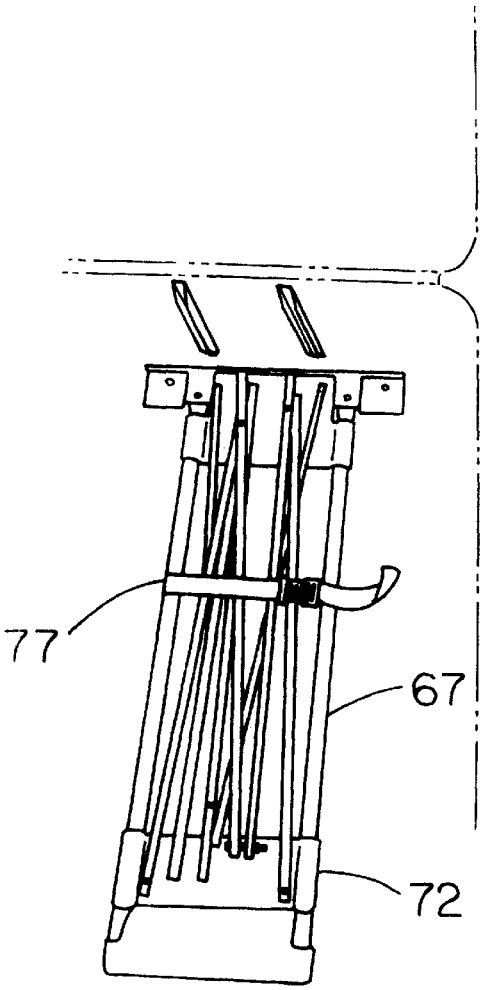
FIG. 9 is a schematic perspective view of the storage means of the present invention.
Figure 10:
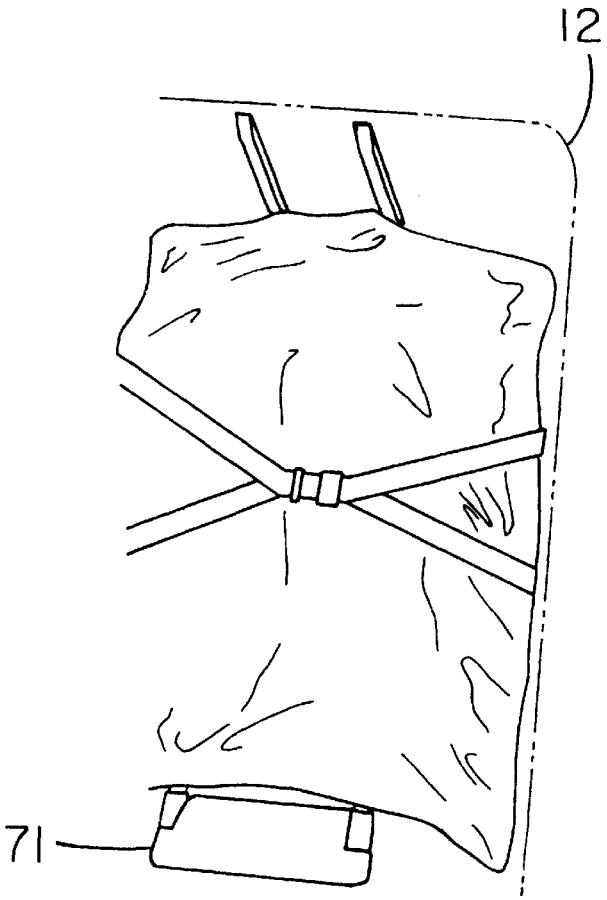
FIG. 10 is a schematic perspective view of clothes being placed over the assembly in the suitcase.

With reference now to the drawings, and in particular to FIGS. 1 through 10 thereof, a new clothes hanging assembly embodying the principles and concepts of the present invention and generally designated by the reference numeral 10 will be described.

As best illustrated in FIGS. 1 through 10, the clothes hanging assembly 10 generally comprises an assembly which is mountable in a suitcase 12. The suitcase 12 has a bottom portion 13 having a bottom wall 14. The bottom wall 14 has two pairs of opposing walls 15, 16 integrally coupled thereto and extending upwardly therefrom. Each of the walls 15, 16 has an interior surface 17. The assembly is removably mountable to each of the interior surfaces 17 of a first pair 15 of the opposing walls.

The assembly comprises a first 20 and second 36 support structure coupled together by a clothing support means 45.

The first support structure 20 includes a pair of legs 21. Each of the legs 21 has a first end 23 and a second end 24. Each of the legs is elongate, and has a pair of bores 25, 26 therethrough. A first of the bores 25 is located generally adjacent to the first end 23 of the legs 21. A second of the bores 26 is located generally adjacent to the second end 24 of the legs 21.

A rod 27 extends through the first bores 25 in the legs 21. The rod 27 pivotally couples the legs 21 together. The rod 27 has a pair of threaded ends each having a nut 28 thereon.

A break 29 is in each of the legs 21. Each of the breaks 29 is generally positioned in a middle portion of the legs 21 such that first portion 30 and a second portion 31 of the legs 21 are defined. The first 30 and second 31 portions are removably coupled together. The first portion 30 has an end having an aperture 32 therein for receiving an upstanding member 33 integrally coupled to an end of the second portion 31. The first portion 30 has a slot 34 therein. The slot 34 extends into the aperture 32. The upstanding member 33 has a protruding member 35 thereon. The protruding member 35 is positionable in the slot 34. The protruding member 34 is adapted for is selectively positioned between a protruding and a recessed position and is biased toward the protruding position.

The second support structure 36 also includes a pair of legs 37. Each of the legs 37 has a first end 38 and a second end 39. Each of the legs 37 is elongate, and each has a bore 40 therethrough generally adjacent to the first end 38 of the legs 37.

A rod 27 extends through the bores 40 in the legs 37 of the second support structure 36. The rod 27 pivotally couples the legs 37 together. The rod 27 has a pair of threaded ends each having a nut 28 thereon.

A break 44 is in each of the legs 37 of the second support structure 36. Each of the breaks 40 is generally positioned in a middle portion of the legs 37 such that first portion 41 and a second portion 42 of the legs 37 are defined. The first 41 and second 42 portions are hingedly coupled together by a hinge 43.

The clothing support means 45 supports clothes and removably couples the first 20 and second 46 support structures together. The clothing support means 45 is an elongate member hingedly coupled to the rod 27 on the first support structure 20. The elongate member has a first end 46 and a second end 47. The first end 46 has a bore therethrough for receiving the rod 27 on the first support structure 20. The elongate member has a channel 48 therein. The channel 48 is generally adjacent to the second end 47 of the elongate member. The channel 48 is positioned to receive the rod 27 on the second support structure 36 when the elongate member is orientated generally horizontal between the first 20 and second 36 structures.

A mounting assembly removably mounts the first and second support structures to the suitcase. The mounting assembly comprises a first 50 and second 60 pair of securing means.

The first pair 50 of securing means removably secures the legs 21 of the first support structure 20 to a first wall 18 of the first pair 15 of opposing walls. Each of the securing means comprises a bracket 51. Each of the brackets 51 is elongate. Each of the brackets is fixedly coupled to the interior surface 17 the first wall 18. The brackets 51 are spaced from each other. Each of the brackets 51 has a channel 52 therein for receiving a portion of the legs 21. Each of the brackets 51 has a bore 53 therein which extend into the channel 52. A pair of pins 54 is each removably insertable into one of the bores 53 in the channels 52 and in one of the second bores 26 in the legs 21.

The second pair of securing means 60 removably secures the legs 37 of the second support structure 36 to a second wall 19 of the first pair 15 of opposing walls. Each of the second pair of securing means 60 comprises a male bracket 61 and a female bracket 64. Each of the male brackets 61 is coupled to and extends away from one of the legs 37 of the second support structure 36. Each of the male brackets 61 has a top edge 62 has a well 63 therein. Each of the female brackets 64 is generally L-shaped and has a first arm 65 and a second arm 66. Each of the first arms 65 has free end hingedly coupled to the interior surface 17 of the second wall 19 such that a free end of each of the second arms 66 extends toward the bottom wall 14 of the suitcase 12. The female brackets 64 are spaced such that each of the female brackets 64 is generally opposed to one of the brackets 51 of the first pair 50 of securing means. Each of the second arms 66 is positionable in one of the wells 64.

A storage means stores the first 20 and second 36 support structures. The storage means comprises a pair of bars 67. Each of the bars 67 is elongate. Each of the bars 67 has a distal portion 68 and a proximal portion 69. Each of the portions 68, 69 of the bars is removably coupled to a first plate 70 and a second plate 71. Each of the plates 70, 71 has a pair of opposing edges 72 forming channels for receiving a portion of said bars 67. Each of the plates 70, 71 has a break therein for selectively altering the distance between the channels. The break defines a first portion 73 and second portion 74 of each of the plates 70, 71. Each of the portions has slots 75 therein. The slots 75 are positioned such that the slots 75 in the first portion 73 may be aligned with the slots 75 in the second 74 portion. A plurality of fastening means 76 selectively fasten the first portions 73 to the second portions 74 and extend through the slots 75. Each of the distal portions 68 of the bars 67 is positioned in one of the channels of the first plate 70 and a each of the proximal portions 69 of the bars 67 is positioned in one of the channels of the second plate 71. A strap 77 is wrapped about the bars 67. The first 20 and second 36 support structures may be positioned between the bars 67 and bound by the strap 78.

In use, the legs 21, 37 of the first 20 and second 36 support structures are collapsible for easy storage. When needed, the support structures 20, 36 are assembled and coupled together with the clothing support means 45. The legs 21, 37 are coupled to the walls 15 of the suitcase 12 for support. Clothes are then hung from the clothing support means 45.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A clothes hanging assembly, said assembly being mountable in a suitcase, the suitcase having a bottom portion having a bottom wall, the bottom wall having a first and a second pair of opposing walls integrally coupled thereto and extending upwardly therefrom, each of said pair of opposing walls having an interior surface, said assembly being removably mountable to each of said interior surfaces of a first pair of the opposing walls, said assembly comprising:

a first support structure;

a second support structure;

a clothing support means for supporting clothes, said clothing support means extending between said first and second support structure;

a mounting assembly comprising:

a first pair of securing means for removably securing said first support structure to a first wall of the first pair of opposing walls;

a second pair of securing means for removably securing said second support structure to a second wall of the first pair of opposing walls; and wherein said first support structure comprises:

a pair of legs, each of said legs having a first end and a second end, each of said legs being elongate, each of said legs having a pair of bores therethrough, a first of said bores being located generally adjacent to said first end of said legs, a second of said bores being located generally adjacent to said second end of said legs; and a rod extending through said first bores in said legs, said rod pivotally coupling said legs together.

2. The clothes hanging assembly as in claim 1, wherein a break is formed in each of said legs, each of said breaks being generally positioned in a middle portion of said legs such that first portion and a second portion of said legs are defined, said first and second portions being removably coupled together, said first portion having an end having an aperture therein for receiving an upstanding member integrally coupled to an end of said second portion.

3. The clothes hanging assembly as in claim 1, wherein said second support structure comprises:

a pair of legs, each of said legs having a first end and a second end, each of said legs being elongate, each of said legs having a bore therethrough generally adjacent to said first end of said legs; and a rod extending through said bores in said legs, said rod pivotally coupling said legs together.

4. The clothes hanging assembly as in claim 2, wherein said second support structure comprises:

a pair of legs, each of said legs having a first end and a second end, each of said legs being elongate, each of said legs having a bore therethrough generally adjacent to said first end of said legs; and a rod extending through said bores in said legs, said rod pivotally coupling said legs together.

5. The clothes hanging assembly as in claim 4, wherein each of said legs of said second support structure has a break formed therein, each of said breaks being generally positioned in a middle portion of said legs such that first portion and a second portion of said legs are defined, said first and second portions being hingedly coupled together.

6. The clothes hanging assembly as in claim 3, wherein said clothing support means comprises:

an elongate member hingedly coupled to said rod on said first support structure, said elongate member having a first end and a second end, said first end having a bore therethrough for receiving said rod on said first support structure, said elongate member having a channel therein, said channel being generally adjacent to said second end of said elongate member, said channel being positioned to receive said rod on said second support structure when said elongate member is oriented generally horizontal between said first and second structures.

7. The clothes hanging assembly as in claim 5, wherein said clothing support means comprises:

an elongate member hingedly coupled to said rod on said first support structure, said elongate member having a first end and a second end, said first end having a bore therethrough for receiving said rod on said first support structure, said elongate member having a channel therein, said channel being generally adjacent to said second end of said elongate member, said channel being positioned to receive said rod on said second support structure when said elongate member is oriented generally horizontal between said first and second structures.

8. The clothes hanging assembly as in claim 7, wherein said each of said first pair of securing means for removably securing said legs of said first support structure to the first wall of the first pair of opposing walls comprises:

a bracket, each of said brackets being elongate, each of said brackets being fixedly coupled to the interior surface the first wall, said brackets being spaced, each of said brackets having a channel therein for receiving a portion of said legs, each of said brackets having a bore therein, said bores extending into said channel, a pair of pins each being removably insertable into one of said bores in said channels and in one of said second bores in said legs.

9. The clothes hanging assembly as in claim 8, wherein said each of said second pair of securing means for removably securing said legs of said second support structure to the second wall of the first pair of opposing walls comprises:

a male bracket and a female bracket, each of said male brackets being coupled to and extending away from one of said legs of said second support structure, each of said male brackets having a top edge having a well therein, each of said female brackets being generally L-shaped and having a first arm and a second arm, each of said first arms having a free end being hingedly coupled to said interior surface of said second wall such that a free end of each of said second arms extends toward the bottom wall of a suitcase, said second brackets being spaced, each of said second arms being positionable in one of said wells.

10. The clothes hanging assembly as in claim 9, further comprising:

a storage means for storing said first and second support structures, said storage means comprising a pair of bars, each of said bars being elongate, each of said bars having distal portion and proximal portion, each of said portions of said bars being removably coupled to a first plate and a second plate, each of said plates having a pair of opposing edges comprising channels for receiving a portion of said bars, each of said distal portions of said bars being positioned in one of said channels of said first plate and a each of said proximal portions of said bars being positioned in one of said channels of said second plate, a strap being wrapped about said bars, wherein said first and second support structures may be positioned between said bars and bound by said strap.

11. A clothes hanging assembly for mounting in a suitcase having a bottom portion having a bottom wall, the bottom wall having a first and a second pair of opposing walls integrally coupled thereto and extending upwardly therefrom, each of said pair of opposing walls having an interior surface, said assembly being removably mountable to each of said interior surfaces of a first pair of the opposing walls, said assembly comprising:

a first support structure, said first support structure comprising:

a pair of legs, each of said legs having a first end and a second end, each of said legs being elongate, each of said legs having a pair of bores therethrough, a first of said bores being located generally adjacent to said first end of said legs, a second of said bores being located generally adjacent to said second end of said legs;

a rod extending through said first bores in said legs, said rod pivotally coupling said legs together, said rod having a pair of threaded ends having a nut thereon;

a break being in each of said legs, each of said breaks being generally positioned in a middle portion of said legs such that first portion and a second portion of said legs are defined, said first and second portions being removably coupled together, said first portion having an end having an aperture therein for receiving an upstanding member integrally coupled to an end of said second portion, said first portion having a slot therein, said slot extending into said aperture, said upstanding member having a protruding member thereon, said protruding member being positionable in said slot, said protruding member being adapted for being selectively positioned between a protruding and a recessed position, said protruding member being biased toward said protruding position;

a second support structure, said second support structure comprising:

a pair of legs, each of said legs having a first end and a second end, each of said legs being elongate, each of said legs having a bore therethrough generally adjacent to said first end of said legs;

a rod extending through said bores in said legs, said rod pivotally coupling said legs together, said rod having a pair of threaded ends having a nut thereon;

a break being in each of said legs, each of said breaks being generally positioned in a middle portion of said legs such that first portion and a second portion of said legs are defined, said first and second portions being hingedly coupled together;

a clothing support means for supporting clothes, said clothing support means being an elongate member hingedly coupled to said rod on said first support structure, said elongate member having a first end and a second end, said first end having a bore therethrough for receiving said rod on said first support structure, said elongate member having a channel therein, said channel being generally adjacent to said second end of said elongate member, said channel being positioned to receive said rod on said second support structure when said elongate member is oriented generally horizontal between said first and second structures;

a mounting assembly, said mounting assembly comprising:

a first pair of securing means for removably securing said legs of said first support structure to a first wall of the first pair of opposing walls, each of said securing means comprising a bracket, each of said brackets being elongate, each of said brackets being fixedly coupled to the interior surface the first wall, said brackets being spaced, each of said brackets having a channel therein for receiving a portion of said legs, each of said brackets having a bore therein, said bores extending into said channel, a pair of pins each being removably insertable into one of said bores in said channels and in one of said second bores in said legs;

a second pair of securing means for removably securing said legs of said second support structure to a second wall of the first pair of opposing walls, each of said second pair of securing means comprising a male bracket and a female bracket, each of said male brackets being coupled to and extending away from one of said legs of said second support structure, each of said male brackets having a top edge having a well therein, each of said female brackets being generally L-shaped and having a first arm and a second arm, each of said first arms having free end being hingedly coupled to said interior surface of said second wall such that a free end of each of said second arms extends toward the bottom wall of a suitcase, said second brackets being spaced, each of said second arms being positionable in one of said wells; and a storage means for storing said first and second support structures, said storage means comprising a pair of bars, each of said bars being elongate, each of said bars having distal portion and a proximal portion, each of said portions of said bars being removably coupled to a first plate and a second plate, each of said plates having a pair of opposing edges comprising channels for receiving portion of said bars, each of said plates having a break therein for selectively altering the distance between said channels, said break defining a first portion and second portion of each of said plates, each of said portions having slots therein, said slots being positioned such that said slots in said first portion may be aligned with said slots in said second portion, a plurality of fastening means for selectively fastening said first portions to said second portions extend through said slots, each of said distal portions of said bars being positioned in one of said channels of said first plate and a each of said proximal portions of said bars being abutted against one of said channels of said second plate, a strap being wrapped about said bars, wherein said first and second support structures may be positioned between said bars and bound by said strap.

* * * * *